United States Patent [19]

Peter et al.

[11] 4,062,532

[45] Dec. 13, 1977

[54] APPARATUS FOR FEEDING AND TRANSPORTING PAPERBOARD BLANKS

[75] Inventors: Jakob Peter, Carmel, Ind.; Perry D. Thatcher; Kenneth L. Steele, both of Middletown, Ohio

[73] Assignee: Koppers Company, Inc., Pittsburgh, Pa.

[21] Appl. No.: 679,813

[22] Filed: Apr. 23, 1976

[51] Int. Cl.[2] ..... B65H 3/04; B65H 3/56; B65H 5/02

[52] U.S. Cl. ..... 271/6; 271/3.1; 271/35; 271/124; 271/164; 271/198; 271/221

[58] Field of Search ..... 271/35, 3.1, 6, 7, 164, 271/162, 4, 198, 200, 165, 171, 221, 124, 138, 34; 214/6 D, 8.5 G

[56] References Cited

U.S. PATENT DOCUMENTS

| | | | |
|---|---|---|---|
| 3,522,943 | 8/1970 | Swanson | 271/3.1 X |
| 3,612,511 | 10/1971 | Godlewski | 271/3.1 X |
| 3,674,258 | 7/1972 | Maier et al. | 271/3.1 X |
| 3,690,650 | 9/1972 | Maier et al. | 271/3.1 X |
| 3,776,544 | 12/1973 | Watson et al. | 271/3.1 |
| 3,815,762 | 6/1974 | Hoke et al. | 271/164 X |
| 3,900,115 | 8/1975 | Kumagai | 271/3.1 X |
| 3,905,490 | 9/1975 | Johnson | 271/3.1 X |

*Primary Examiner*—Bruce H. Stoner, Jr.
*Attorney, Agent, or Firm*—Thomas L. Sivak; Oscar B. Brumback

[57] ABSTRACT

Apparatus for feeding and transporting blanks of corrugated paperboard and the like is disclosed wherein a stack of blanks is received on a blank feeding station having a first belt-over-roller conveyor which cooperates with an angularly inclined control gate of a gate assembly to feed blanks from the bottom of the stack beneath the control gate and effect shingling of the blanks, whereafter the blanks are transported to a receiving station such as the feed hopper of a printing press or the like. The control gate is adjustable to vary the shingling relationship of the blanks fed from the bottom of the stack and has a low friction surface thereon facilitating optimum operation.

3 Claims, 3 Drawing Figures

APPARATUS FOR FEEDING AND TRANSPORTING PAPERBOARD BLANKS

BACKGROUND OF THE INVENTION

1. Field of the Invention

This invention relates generally to sheet feeding or delivering and more particularly to feeding pack advancers; specifically, the invention relates to apparatus for feeding blanks of corrugated paperboard and the like from the bottom of a stack in shingled fashion for transport to a blank receiving station such as the feed hopper of a printing press.

2. Description of the Prior Art

It has long been a goal of the corrugating industry to achieve optimum feeding of corrugated blanks to printing presses and the like. The known apparatuses for automatic feeding of corrugated paperboard have not been satisfactory in that they have lacked the ability to consistently feed a wide range of sizes and shapes of corrugated board to the typical printing presses. The present invention provides an apparatus for feeding corrugated paperboard which overcomes the disadvantages found in the known corrugated board feeding apparatus, and which provides the desired consistency in feeding wide ranges of sizes and shapes of paperboard to, for example, the feed hopper of a printing press.

Sheet feeders per se are used for many applications such as feeding small punched computer cards to newspapers to very large sheets or blanks of corrugated or solid fibre paperboard to sheets of wood and the like. Many feeders are adapted to feed single sheets one at a time in serial fashion, either in timed or untimed relation to portions of associated equipment; still others are adapted to feed sheets in overlapped or shingled fashion. The feeding portion of the present invention falls into the latter category.

Examples of feeders for feeding shingled sheets may be found by referring to U.S. Pat. Nos. 3,262,697, 3,776,554, 3,622,149, and 3,522,943, to name but a few. However, the primary purpose of the present invention is to feed blanks of corrugated paperboard from a stack of such blanks and transport them to the feed hopper of a blank printing press or similar machine to achieve automatic loading of the press as opposed to the customary manual loading. Such press loaders, as they are commonly called, currently exist and are of many different types. Pertinent examples may be found in U.S. Pat. Nos. 3,422,969, 3,643,939, 3,815,762, and 3,827,576 to generally show the state of the art.

Press loading machines of the type mentioned above are usually quite large, complex, and expensive. In addition, many are limited to loading a fairly small range of blank sizes and some suffer from a lack of reliability which defeats the purpose for which they are intended.

Accordingly, the principal object of the present invention is to provide a press loading machine of relatively simple construction capable of loading a wide range of blank sizes and characterized by the desired reliability of operation.

Another primary object of the present invention is to provide apparatus for feeding corrugated blank material and the like from a stack of blanks to a receiving station, wherein the blanks are removed from the bottom of the stack and transferred in shingled relation.

Another object of the present invention is to provide an apparatus for feeding corrugated blank material and the like from a stack of blanks in shingled form along a predetermined path to a receiving station such as the feed hopper of a printing press, the apparatus employing spanking means adjacent the feed hopper to maintain proper orientation of the blanks as they are fed into the feed hopper.

Another object of the present invention is to provide apparatus for feeding corrugated blanks and the like as described which includes a novel control gate operative to effect selective shingling of blanks fed from the bottom of a stack of blanks by a belt-over-roller conveyor.

SUMMARY OF THE INVENTION

The invention generally comprises apparatus for feeding corrugated or similar paperboard blanks in shingled fashion from an upright stack to a blank receiving station, such apparatus including a feeding station for shingling the blanks from beneath the stack and a transport conveyor for moving the shingled blanks to the receiving station. The feeding station includes a transfer conveyor for supporting the stack and urging it against an upright abutment and gate portion of the feeding section.

A feature of the present invention lies in the provision of a preformed covering on the control gate to provide a relatively low coefficient of friction and facilitate the desired shingling and feeding of blanks from the bottom of a stack of blank material.

Another feature of the present invention lies in the provision of means for adjusting the spacing of the control gate relative to the belt-over-roller conveyor which draws the blanks from the bottom of a stack to control the degree of shingle of the sheets relative to each other.

A still further feature of the present invention lies in the provision of spanker means to maintain the individual blanks in a desired orientation as they are fed to a receiving station such as the feed hopper of a printing press.

The above and further objects and novel features of the invention will appear more fully from the following detailed description when the same is read in connection with the accompanying drawings. It is to be expressly understood, however, that the drawings are not intended as a definition of the invention but are for the purpose of illustration only.

BRIEF DESCRIPTION OF THE DRAWINGS

In the drawings wherein like parts are marked alike.

DESCRIPTION OF THE PREFERRED EMBODIMENT

Figure 1:
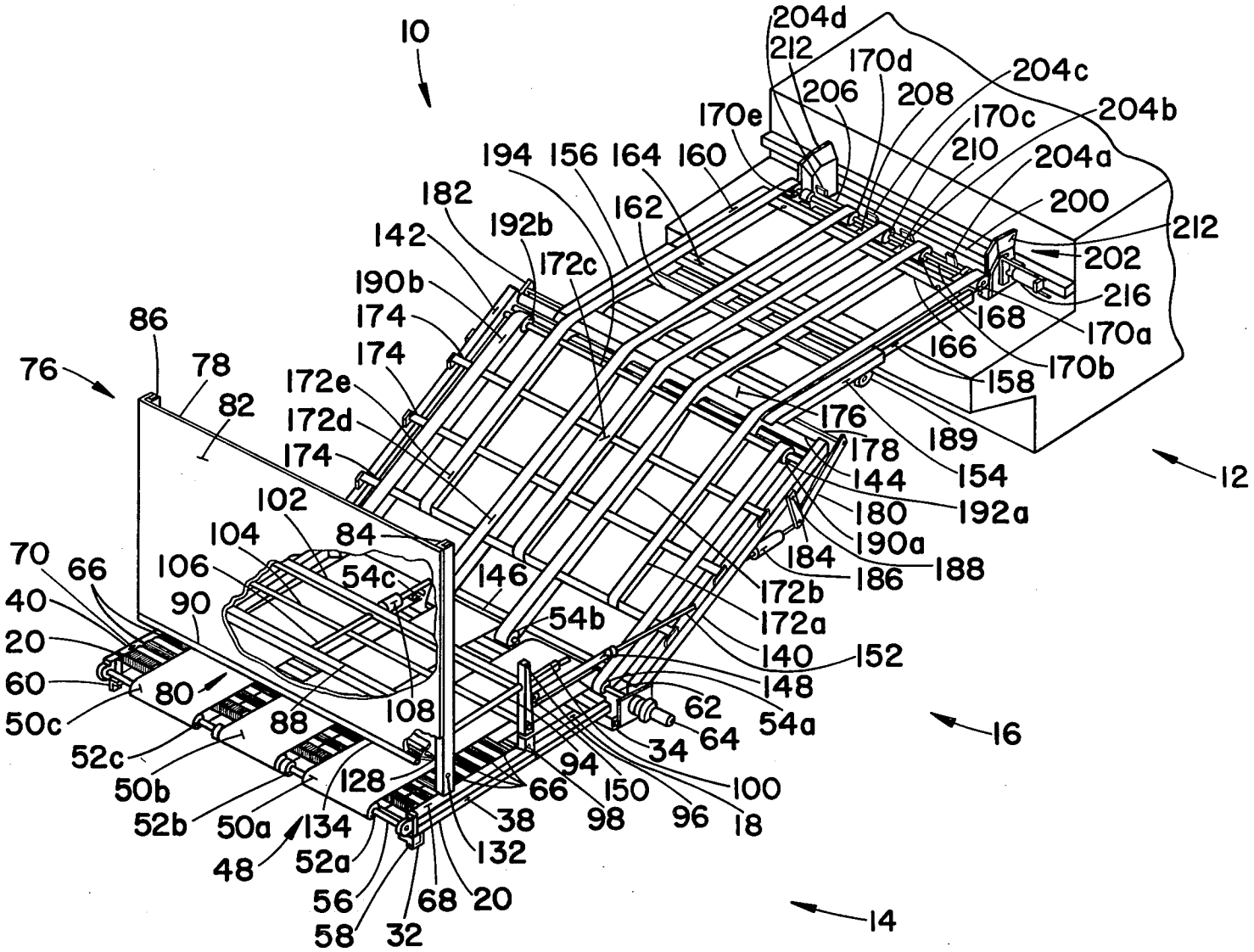
FIG. 1 is a perspective view illustrating apparatus in accordance with the present invention for feeding corrugated blanks from a stack to a receiving station such as the feed of a printing press.

Referring now to the drawings, and in particular to FIG. 1, apparatus constructed in accordance with the present invention for feeding corrugated blanks and the like from a stack of blanks to a receiving station is indicated generally at 10. For purposes of illustration, the apparatus 10 is shown as being disposed adjacent a feed hopper, indicated partially at 12, of a printing press of known design which is operative to print on corrugated blanks. The apparatus 10 facilitates feeding of corrugated blanks in shingled relation to the feed hopper 12 in a manner to maintain the hopper at a desired level preparatory to printing on the blanks. A stack of corrugated sheet material, such as corrugated or solid fiber paperboard blanks or the like, is indicated generally at 13 in FIG. 2 disposed on a feeding station portion 14 of the apparatus 10. The stack 13 of corrugated blanks may be delivered to the feeding station of the apparatus 10 from conventional means (not shown) such as a conveyor system adapted to transfer successive stacks of corrugated blanks to the apparatus 10.

In addition to the sheet feeder station portion 14, the apparatus 10 includes an outrigger or transport portion, indicated generally at 16, which is operatively connected to the feeder station portion 14 and adapted to transport blanks from the feeder station portion to the feed hopper 12.

Figure 2:
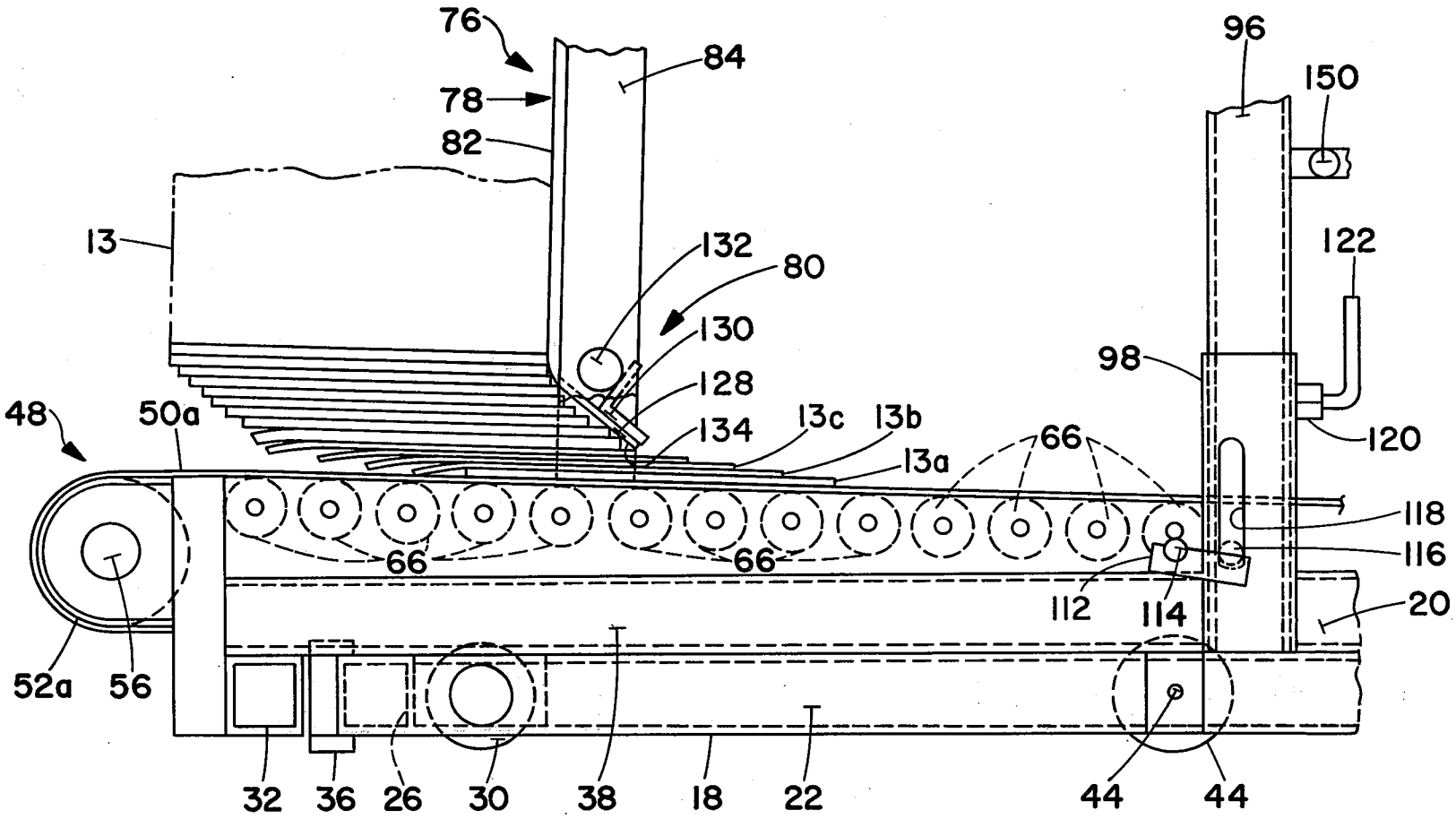
FIG. 2 is an enlarged side elevational view of a portion of the apparatus of FIG. 1 to more clearly illustrate the operation of the control plate in effecting shingling of blanks fed from the bottom of a stack of blanks.
Figure 3:
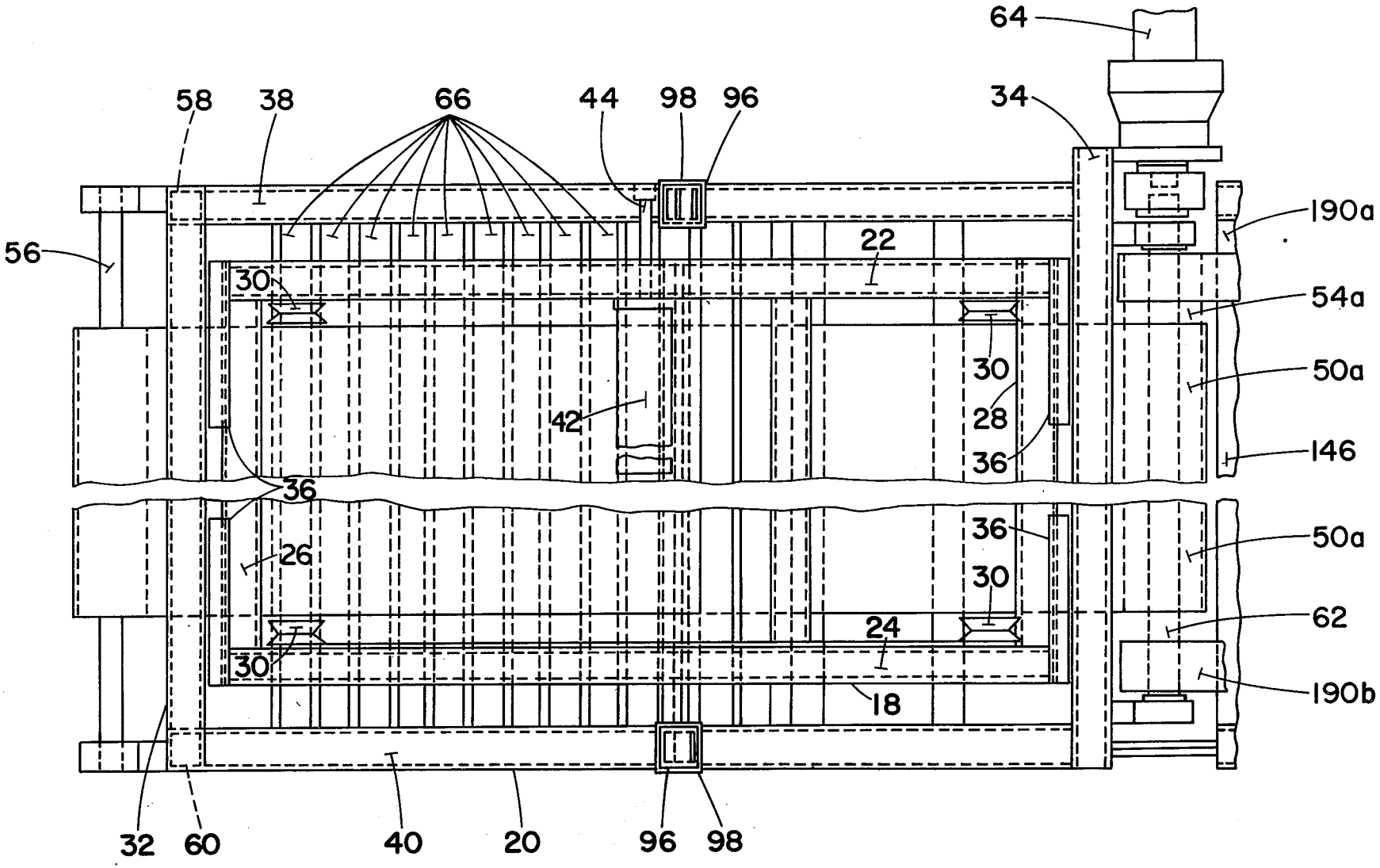
FIG. 3 is an enlarged, laterally foreshortened, bottom view of the feed station of the apparatus of FIG. 1 showing the relatively stationary and shiftable frame assemblies.

With reference to FIG. 1 taken in conjunction with FIGS. 2 and 3, the feeder station portion 14 includes a stationary frame assembly 18 and a shiftable frame assembly 20. The stationary frame assembly 18 includes a pair of laterally spaced longitudinally extending frame or beam members 22 and 24 secured at their opposite ends to transverse frame members 26 and 28. The frame members 22 and 24 each have a pair of guide wheels 30 rotatably supported thereon which are adapted for rolling engagement with guide rails (not shown) to facilitate movement of the feeder station portion 14 in the longitudinal direction of the apparatus 10 and thus allow positioning of the apparatus 10 relative to a feed hopper or the like such as indicated at 12.

The shiftable frame assembly 20 includes a pair of transverse frame or beam members 32 and 34 each of which has a pair of C-shaped guide bearings 36 secured thereto. A pair of laterally spaced frame or beam members 38 and 40 are secured to the upper surfaces of the transverse frame members 32 and 34 at the opposite ends thereof so as to establish a substantially rectangular shiftable frame assembly 20. The guide bearings 36 are slidingly cooperable with the transverse beam members 26 and 28 of the stationary frame assembly 18 such that the shiftable frame assembly 20 may be shifted laterally relative to the stationary frame assembly 18. To this end, a suitable pneumatic or hydraulic actuating cylinder 42 is secured to the frame member 22 and has its axially extendible piston 44 connected to the frame member 38 such that extension and retraction of the piston 44 will effect a corresponding shifting of the frame assembly 20 relative to the frame assembly 18. As will become more apparent hereinbelow, such lateral shifting of the shiftable frame assembly 20 may be desirable during operation of the apparatus 10 to shift a stack of blanks, such as indicated at 13 in FIG. 2, to a preferred transverse position relative to the transport portion 16 to obtain the desired positioning of the blanks within the feed hopper 12.

The shiftable frame assembly 20 supports first movable transfer means, indicated generally at 48, FIG. 2, which serves to receive the stack of blanks 13 thereon and effect selective movement of the blanks along the apparatus 10. The transfer means 48 includes a plurality of endless conveyor or transfer belts, there being three identical conveyor belts indicated in the illustrated embodiment at 50*a*, 50*b* and 50*c*. The conveyor belts 50*a*, 50*b* and 50*c* are reeved over respective pairs of rollers 52*a* and 54*a*, 52*b* and 54*b*, and 52*c* and 54*c*. The rollers 52*a*, 52*b* and 52*c* are supported on a shaft 56 which is rotatably supported by support columns 58 and 60 secured in upstanding relation to the opposite ends of the transverse support beam 32. The rollers 54*a*, 54*b* and 54*c* comprise rubber covered drive rollers and are secured on a transverse drive shaft 62 one end of which is operatively connected to a variable speed motor such as a conventional variable speed hydraulic drive motor shown at 64 in FIGS. 1 and 3. The motor 64 rotates the belts 50*a–c* and thus, in this sense, the transfer means of the feed station 14 is movable.

A plurality of transversely disposed idler rollers 66 have their opposite ends rotatably supported by plate members 68 and 70 which are secured, respectively, to the upper surfaces of the frame members 38 and 40 and the associated support columns 58 and 60 of the shiftable frame assembly 20. The idler rollers 66 are positioned such that their uppermost surfaces lie in a common plane tangent to the peripheral surfaces of both the idler rollers 66 and the rollers 52 *a–c* and 54 *a–c*. The idler rollers 66 support an upper reach of the conveyor belts 50 *a–c* and thus provide the support for the conveyor belts 50*a–c* when a stack of blanks 13 is received on the feeder station 14.

The shiftable frame assembly 20 of the feeder station 14 also supports gate means, indicated generally at 76, which serves to control and meter feeding of the blanks 13 in shingled fashion from a stack disposed upon the feeder station 14 to the transport section 16 and on to the feed hopper 12. The gate means 76 includes upstanding abutment means, indicated generally at 78, and control gate or shingling means, indicated generally at 80. The upstanding abutment means 78 includes a planar plate member 82 which extends substantially the full lateral width of the movable frame 20 and has its lateral edges secured to and supported by elongated support members 84 and 86.

The plate member 82 may be made of plywood sheet or other suitable strength material sufficient to serve as an abutment means for a stack of blanks 13 when disposed on the feeder station 14 preparatory to shingling the blanks. The shiftable frame assembly 20 and associated plate member 82 are adapted to accommodate corrugated blanks 13 having widths, considered transverse to the longitudinal axis of the apparatus 10, that is, along the path of travel of the blanks, of up to approximately 90 inches. The plate member 82 has a height sufficient to extend the full height of a stack of corrugated blanks 13 having a height of approximately 82 inches. One or more beams such as shown at 88 may be secured to and between the support members 84 and 86, as shown in FIG. 1. The plate member 82 has a lower edge 90 disposed parallel to the plane of the reach of the feeder belts 50 *a–c* overlying the idler rollers 66.

The gate means 76 is vertically and longitudinally adjustable relative to the shiftable frame assembly 20. To this end, the support members 84 and 86 are identically mounted on the rearward ends of a pair of laterally spaced support rods, one of which is indicated at 94 in FIG. 1 secured to the support member 84. The support rod 94 is, in turn, supported by a vertical support beam 96 the lower end of which is received in telescope fashion within a square tubular support member 98. The support member 98 is mounted on the lateral frame member 38 of the shiftable frame 20. The support rod 94 is longitudinally slidable through a suitable opening in the support beam 96 and if further received through a stabilizing sleeve 100 affixed to and between the support beam 96 and its counterpart on the opposite side of the shiftable frame 20 to add rigidity to the frame support for the abutment means 78 and associated control gate means 80.

A control rod 106 is secured in normal relation to the beam 88 centrally of its length and extends therefrom forwardly through the cross beam 102. The control rod 106 may be threaded along its length for a sufficient distance to be threadedly engaged by an adjustment nut 108 which is mounted on the cross beam 102 and is rotatable to effect movement of the plate member 82 longitudinally along the shiftable frame assembly 20 thereby providing adjustment of the plate member 82 relative to the rearward ends of the transfer belts 50 *a–c* as defined by the rollers 52 *a–c*. Such adjustment is made to facilitate operation with stacks of corrugated blanks 13 of different lengths, usually between 8½ and 38 inches, considered in the longitudinal direction of the apparatus 10. The support rod 94 and its counterpart of the opposite side of the shiftable frame assembly 20 form right angles with their respective support members 84 and 86 but are slightly angularly inclined relative to the frame members 38 and 40 such that the plane of the plate member 82 is substantially perpendicular to the plane of the reach of the feeder belts 50 *a–c* overlying the idler rollers 66. It will be noted from FIG. 2 that the axes of rollers 66 lie in a plane which is downwardly inclined relative to the frame members 38 and 40 toward the forward end of the feeder station 14, as defined by the drive rollers 54 *a–c*. In this manner, a stack of corrugated blanks 13 disposed on the conveyor belts 50 *a–c* will be urged by gravity against the plate member 82 to prevent the stack from toppling backward, this being particularly desirable where stacks of sheets of relatively narrow dimension are being fed by the apparatus 10.

With particular reference to FIG. 2, the support beam 96 and its counterpart on the opposite side of the shiftable frame 20, are vertically movable relative to the support members 98 by means of control arms 112 which are pivotally mounted on the respective plate members 68 and 70 through axially aligned pivot pins 114. The control arms 112 on the opposite sides of the shiftable frame 20 underlie axially-aligned stub shafts, one of which is indicated at 116, which are secured to the lower ends of the support beams 96 and are received through suitable elongated slots 118 in the respective support members 98. Means (not shown) are provided for rotating or pivoting the control arms 112 in a direction to move the support beams 96 longitudinally upwardly or downwardly relative to the support members 98 to effect a corresponding vertical adjustment of the upstanding abutment means 78 and control gate means 80. A suitable set screw 120 and associated screw adjusting wrence member 122 are mounted on each of the support members 98 and are operative to lock the support beams 96 in their desired vertical positions relative to the support members 98.

With reference to FIG. 1, taken in conjunction with FIG. 2, the control gate means 80 includes a planar control plate 128 which extends between the support members 84 and 86. The control gate 128 is secured to an angle bracket 130 which, in turn, is secured to a pivot shaft 132 having its opposite ends rotatably received within suitable axially aligned openings in the support members 84 and 86. It will be appreciated that by so mounting the control plate 128 on the pivot shaft 132, the control plate 128 may have its angle of inclination relative to the plane of the upper reach of the transfer belts 50 *a–c* varied as desired through rotational movement of the pivot shaft 132 about its axis. Means (not shown) are provided for securing the control plate 128 in the selected angle of inclination. A preformed nylon plate or other low friction facing 134 is suitably secured to the lower inclined surface of the control plate 128 to provide a sliding surface of relatively low coefficient of friction when the control gate means is engaged by the forward edges of corrugated blanks 13 as they are being fed from the feeding station 14. The nylon cover may be secured to the control plate 128 by conventional means such as a suitable adhesive or countersunk screws. It has been found that optimum operation occurs when the angle of inclination between the control plate 128 and its associated nylon cover 134 and the plane of the opposed upper reach of the transfer belts 50 *a–c* is between approximately 35°–40°, and preferably is set at 37.5°.

In the operation of the feeder station 14, a stack of blanks 13 are conveyed to the feeder station 14 from a separate infeed conveyor (not shown) of conventional known design and deposited on the transfer belts 50 *a–c* rearwardly of the plate member 82. During such loading of the stack of blanks on the feeder station 14, the transfer belts are driven by drive motor 64 at a "transfer" speed so as to urge the stack against the plate member 82, assisted by the downward inclination of the feeder belts 50 *a–c* and associated idler rollers 56 thus forming a substantially upright stack of blanks. As soon as the leading edge of the stack of blanks 13 engages the gate plate 82, the speed of motor 64 is increased to effect the desired "feeding" speed of the transfer belts 50 *a–c* so as to draw the lowermost sheet from the stack 15 in a forward direction. The drive motor 64 is adapted to effect a surface speed of approximately 195 feet per minute for the feeder belts 50 *a–c*.

As the lowermost blank 13*a* is partially drawn from the lower end of the stack 13, the rear edge portion of the next above blank 13 *b* will engage the transfer belts 50 *a–c* and be drawn from the bottom of the stack. Similarly, when the blank 13*b* has been partially drawn from the bottom of the stack, the rear edge portion of the next above blank 13c in the stack engages the belts 50 *a–c* and is drawn in a forward direction from the bottom of the stack. As the first or bottom blank 13a is initially drawn from the bottom of the stack, the forward edges of the above blanks are drawn against the cover 134 on the control plate 128. The control plate 128 and associated cover 134, and their inclined position relative to the belts 50 *a–c* control the degree or extent of shingle of each blank on the next below blank. The lowermost edge of the control plate 128 and associated cover 134 is preferably disposed approximately 1¼ inch above the plane of the transfer belts 50 *a–c* when the blanks being transferred have thicknesses of approximately one-fourth inch. Thus, approximately five of the blanks 13 may pass under the control gate means 80, with the above blanks engaging the control plate 128 and plate member 82. By changing the gap between the lower edge of the control plate 128 and the upper surfaces of the opposing reach of the transfer belts 50 *a–c*, the degree of shingling of the blanks 15 may be controlled; that is, the distance between the leading edges of the shingled blanks may be controlled and results in selective feeding of the blanks. It has been found that an angle of inclination of less than approximately 35°, such as 30°, will result in unsatisfactory feeding, while an angle of inclination greater than approximately 45° will present flow problems. As noted, an angle of inclination for the control plate 128 of between approximately 35° and 40°, preferably 37.5°, has been found to provide the desired feeding and shingling of the blanks.

After the blanks of corrugated material are fed from beneath the stack disposed on the feeder station 14 of the apparatus 10, the blanks are transported in shingled form from the feeder station 14 to the feed hopper 12 by the outrigger conveyor portion 16. As shown in FIG. 1, the conveyor portion 16 of the apparatus 10 includes a first generally rectangular frame having lateral frame members 140 and 142 which are secured at their opposite ends to parallel, spaced transverse frame members 144 and 146. The frame thus formed by the frame members 140, 142, 144 and 146 is pivotally mounted on the drive shaft 62 to allow pivoting of the conveyor 16 relative to the feeder station 14. An actuating cylinder 148 is pivotally secured to the support beam 96 at 150 and has an extendible piston 152 pivotally secured to the frame member 140. Means (not shown) are provided for effecting selective extension and retraction of the piston 152 to vary the angle of inclination of the conveyor 16 relative to the feeder station 14. In the illustrated embodiment, the conveyor 16 is hinged at an upward angle of approximately 21° from the feeder station 14, but can be pivoted to a near vertical position.

The transverse frame member 144 is cylindrical and has a pair of longitudinally extending, laterally spaced, beam members 154 and 156 secured thereto. The beam members 154 and 156 telescopingly receive beam supports 158 and 160, respectively, in supported relation therein. A transverse idler roller 162 and a transverse frame member 164 are mounted between the beams 154 and 156, the member 164 providing structural rigidity therefor. The support beams 158 and 160 have their forward ends secured to a transverse beam 166 which supports a rotatable roller shaft 168 having a plurality of belt support rollers 170*a*, 170*b*, 170*c*, 170*d* and 170*e* mounted thereon. The rollers 170*a–e* support the forward ends of a plurality of outrigger conveyor belts 172*a–e*, respectively. As shown, the belts 172*a*, 172*b* and 172*e* pass over the transverse idler roller 162, the cylinder frame member 144, and over a plurality of transverse parallel spaced idler rollers 174 rotatably mounted on the frame members 140 and 142 of the conveyor frame. The transport conveyor belts 172*b* and 172*d* pass over the same frame elements and rollers but have their rearward ends drivingly connected to the rubber-covered drive roller 154*b* such that rotation of the drive shaft 62 will effect rotation of the rollers 170*a–e* to rotate the transfer belts 172*a*, *c* and *d* at the same surface speed as the transfer belts 50*a–c*.

A slack take-up roller 176 is rotatably supported on a shaft 178 which is supported by a pair of laterally spaced support arms 180 and 182 each of which is secured to a respective pivot leg, such as shown at 184 in FIG. 1. The pivot legs 184 are pivotally connected to and supported by the frame members 140 and 142 as at 188. A suitable actuating cylinder 186 is mounted between the frame member 140 and the support leg 184 and is operable to position the slack take-up 176 to maintain substantially constant belt tension in the belts 172*a–e* when the beam support members 158 and 160 are extended or retracted relative to their respective support beams 154 and 156. Selective telescoping or extension movement of support beams 158 and 160 relative to beams 154 and 156 above may be effected by known means such as rotatable gears or drive wheels 189 engaging the lower surfaces of the support beams 158 and 160.

The transport conveyor 16 has an additional pair of laterally spaced conveyor or transfer belts 190*a* and 190*b* reeved over the drive pulleys 54*a* and 54*c* and a forward pair of rollers 192*a* and 192*b* disposed on a transverse rotatable shaft 194. As the blanks 13 pass from the feeder station 14, they are carried up the inclined conveyor 16 by the belts 172*a–e*, and possibly 190*a–b*, to the press feeder station 12.

To insure that the blanks delivered to the feeder 12 are in the desired "squared"or aligned relation, rear edge spanker means, indicated generally at 200, and side edge spanker means, indicated generally at 202, are provided to "spank" the respective blanks as they are fed to the feed hopper 12. The rear edge spanker means 200 includes a plurality of upstanding fingers 204*a–d* which are carried on a transversely disposed support bracket 206. The support bracket 206 is secured on the forward ends of a pair of reciprocating or oscillating members 208 and 210 of known design which are operative to effect a relatively high frequency oscillation of the fingers 204*a–d* in the longitudinal direction of the apparatus 10. The spanker fingers 204 *a–d* are of suitable height to engage the rear edge of each blank 13 as it passes from the transport belts 172*a–172e*. The oscillating members 208 and 210 may be air operated and controlled by a conventional fluidic device so that the fingers 204 *a–d* are lowered to allow the forward edge of each blank to pass thereover and thereafter the fingers engage or spank the rear edge of the blank.

The side edge spanker means 202 includes a pair of generally vertically disposed spanker members 212, each of which is mounted on the forward end of an oscillator 216. Reciprocation of the respective spanker members 212 and 214 in a direction transverse to the longitudinal axis of the apparatus 10 to engage or spank the lateral edges of each blank 13 is effected in similar fashion to the spanker fingers 20*a–d*. The spanker members 212 and their associated oscillators 216 may be adjusted transversely of the apparatus 10 to accommodate sheets of different widths while maintaining the desired spanking functions.

Thus, in accordance with the present invention, a blank feeding and transporting apparatus 10 has been provided which includes a feeder station 14 having gate means 76 including an upstanding abutment 78 and a control gate 80 to facilitate feeding of blanks 13 of corrugated material such that the blanks are fed from the bottom of the stack in shingled relation and are transported to the press hopper 12 along the outrigger conveyor 16, the blanks undergoing a final orientation, if needed, by the spanker means 200 and 202 to maintain the blanks in desired orientation as they enter the feed hopper 12.

Thus, the invention having been described in its best construction and mode of operation, that which is desired to be claimed by Letters Patent is:

1. A feeder apparatus for advancing paperboard blanks from a stack of blanks along a predetermined path of travel in shingled fashion, said apparatus including:

a frame means;

a first conveyor means supported by said frame means and defining a first reach of said path; and a gate means supported by said frame means in overlying relation to said first conveyor means and defining with said first reach of said path of blank material receiving area to receive blanks in stacked form, said gate means including an upstanding wall having a lower edge parallel to and spaced upwardly from said first reach of said first conveyor means, said upstanding wall establishing a stop surface for abutment by common side edges of said blanks to maintain said blanks in stacked form.

said gate means including a control plate pivotally supported adjacent said lower edge of said upstanding wall, said control plate being angularly inclined relative to the plane of said first reach of said conveyor means at an angle of inclination of between about 35°–40°, said control plate having a lower edge disposed parallel to said first reach of said conveyor means and spaced thereabove a distance sufficient to allow a predetermined number of said sheets to pass therebeneath upon movement thereof with said conveyor means along said first reach, said inclined control plate being operative to effect shingling of said blanks passing from the bottom of said stack along said first reach beneath said control plate.

2. Apparatus for feeding paperboard blanks in a shingled fashion from an upright stack of such blanks to a blank receiving station comprising in combination:

a blank feeding station including a moveable transfer means for supporting a stack of blanks thereon, abutment means above said transfer means comprising a plate means supported substantially vertically relative to said transfer means and extending across the width thereof for restraining forward movement of a stack of blanks on said transfer means, said abutment means including shingling means including a laterally extending planar control surface inclined downwardly from a front surface of said plate means in a direction away from said stack of blanks, and terminating a distance above said transfer means to permit passage of a preselected number of shingled blanks between said control surface and said transfer means and onto transport means for transport to a blank receiving station, said planar control surface being fixably mounted on pivotable shaft means for selectively adjusting the incline of said planar control surface between an angle of 35° to 40° relative to a top planar surface of said transfer means, said transfer means including a conveyor belt means extending substantially horizontally beneath said abutment means, said transport means including a conveyor belt means operably associated with said transfer means for receiving shingled blanks thereon and moving the same thereon in shingled fashion to said blank receiving station; and spanker means operably connected to said transport means, said spanker elements disposed on said transport means for aligning the trailing edges of said shingled blanks and disposed in operative relation to said transport means for aligning the lateral sides of said blanks.

3. The apparatus of claim 2 wherein said angle is adjustable to 37.5°.

* * * * *